US005696544A

United States Patent [19]

Komuro

[11] Patent Number: 5,696,544

[45] Date of Patent: Dec. 9, 1997

[54] INK JET HEAD SUBSTRATE AND INK JET HEAD USING SAME ARRANGED STAGGEREDLY

[75] Inventor: Hirokazu Komuro, Yokohama, Japan

[73] Assignee: Canon Kabushiki Kaisha, Tokyo, Japan

[21] Appl. No.: 421,256

[22] Filed: Apr. 13, 1995

[30] Foreign Application Priority Data

Apr. 14, 1994 [JP] Japan ..... 6-075989

[51] Int. Cl.[6] ..... B41J 2/14; B41J 2/16

[52] U.S. Cl. ..... 347/50; 347/58

[58] Field of Search ..... 347/50, 57, 58, 347/42, 56, 205, 209, 211; 361/777; 257/723, 724, 786; 174/261

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,463,359 | 7/1984 | Ayata et al. | 347/56 |
| 4,723,129 | 2/1988 | Endo et al. | 347/56 |
| 4,740,796 | 4/1988 | Endo et al. | 347/56 |
| 4,812,859 | 3/1989 | Chan et al. | 347/63 |
| 4,860,033 | 8/1989 | Shiozaki et al. | 347/64 |
| 4,881,318 | 11/1989 | Komuro et al. | 29/827 |
| 5,016,023 | 5/1991 | Chan et al. | 347/42 |
| 5,091,737 | 2/1992 | Toganoh et al. | 347/50 |
| 5,157,418 | 10/1992 | Tamura | 347/50 |
| 5,160,945 | 11/1992 | Drake | 347/42 |
| 5,220,354 | 6/1993 | Toyosawa et al. | 347/209 |
| 5,241,326 | 8/1993 | Tagashira | 347/205 |
| 5,322,811 | 6/1994 | Komuro et al. | 437/51 |

FOREIGN PATENT DOCUMENTS

| | | |
|---|---|---|
| 54-51837 | 4/1979 | Japan . |
| 59-95154 | 6/1984 | Japan . |
| 59-123670 | 7/1984 | Japan . |
| 59-136616 | 8/1984 | Japan . |
| 59-138461 | 8/1984 | Japan . |

*Primary Examiner*—Benjamin R. Fuller
*Assistant Examiner*—L. Anderson
*Attorney, Agent, or Firm*—Fitzpatrick, Cella, Harper & Scinto

[57] ABSTRACT

An ink jet head substrate including a base plate; an elongated through opening, for ink supply port, extending in a longitudinal direction of the base plate; a plurality of heat generating resisters arranged on the base plate along both sides of the opening; a pair of electrodes electrically connected to the heat generating resisters; electrode pads for external electric connection, the pad being arranged adjacent opposite ends of the base plate substantially in parallel with a line along which the heat generating resisters are arranged; wherein a length Ls of the base plate measured in a direction along the line, a length Lh of a range in which the heat generating resisters are arranged, and a length Lp of a range in which the pads are disposed, satisfy $$Lp \leqq Ls-2\times(Ls-Lh).$$

16 Claims, 6 Drawing Sheets

INK JET HEAD SUBSTRATE AND INK JET HEAD USING SAME ARRANGED STAGGEREDLY

FIELD OF THE INVENTION AND RELATED ART

The present invention relates to an ink jet head substrate and an ink jet head using the same wherein ink is ejected through an orifice in the form of a droplet, more particularly to an ink jet head substrate and an ink-jet head using the same in which an ink jet head substrates ejecting the ink in a direction perpendicular to the substrate having a plurality of heat generating resistors for ejecting the ink, are arranged on a flat plate staggeredly, and/or, an ink jet unit having nozzles and ejection outlets are staggeredly disposed on said ink jet head substrate.

An ink jet printing method as disclosed in Japanese Laid-Open Patent Application No. 51837/1979, for example, has peculiar features as compared with other ink jet printing method in that the power for ejecting the ink is thermal energy applied to the liquid.

More particularly, the recording or printing method disclosed in the Japanese Laid-Open Patent Application, the liquid is heated by the thermal energy to create a bubble, and the expanding force of the bubble eject the liquid through an orifice at an end of the recording head to the recording material so that a desired recording of information or pattern is carried out. Generally, the ink jet head therefor, comprises an orifice for ejecting the liquid, and a liquid passage including heat acting portion where the thermal energy for ejecting the droplet through the orifice is applied to the liquid, which constitute a liquid ejecting portion. It further comprises a heat generating resistor layer (electrothermal transducer) for generating thermal energy, an upper protection layer for protecting the heat generating resistor layer from the ink and a lower layer for accumulating sheet.

As disclosed in Japanese Laid-Open Patent Application No. 95154/1984, the orifice plate is bonded to the substrate, so that a recording head of the type in which the liquid is ejected in a direction perpendicular to the heat acting portion, is provided.

FIG. 8 shows a typical example of such a type of recording head. A substrate (heater board) 100 has an elongated ink supply port (not shown) at the center thereof. A plurality of heat generating resistors are juxtaposed with the ink supply port therebetween such that the distances between the heat generating resistors and the ink supply port are substantially the same. The ink is supplied from the backside of the substrate 100. The electric wiring is provided to supply the electric energy to the heat generating resistors, and is electrically connected with electrode pads 103 for external connection, which are disposed at opposite end surfaces of the substrate 100 in the same direction as the line along which the heat generating resistors are arranged. To the substrate 100, an orifice plate 107 is bonded, by which the head shown in FIG. 8 is manufactured.

As for such an ink jet head, a further increase of the recording speed is desired. As a means for meeting the desire, increase of the length of the ink jet head is considered. More particularly, by increasing the recording width, the number of dots simultaneously printed can be increased, so that the printing speed is increased. As a typical example of such an ink jet head, a full-line type ink jet head has been proposed. With this, the printable width is larger than a width of the recording material, and therefore, the recording head is not moved, and only the recording material is fed, so that it is excellent in the increase of the recording speed.

Usually, the long type ink jet head is constituted by a plurality of head unit. This is because, if an attempt is made to manufacture one long ink jet head using one substrate, there exists the limitation to the length from the maximum size of the silicone wafer. Additionally, a greater number of electrothermal transducers than in the conventional ink jet head, is much larger in the long type recording head with the result of significantly increased probability of occurrences of unsatisfactory electrothermal transducers. So, the yield is very low.

If the above-described head units are arranged on one line (non-staggered), non-printable part occurs at the connecting portion between adjacent head units, which is not preferable. In order to avoid the non-printable portion, the ink supply port has to extend to the end of the substrate in the direction of the arrangement of the heat generating resistors with the result of dividing the substrate. U.S. Pat. Nos. 5,016,023 and 5,160,945 and so on propose staggered arrangement of the head units on a flat plate.

By the staggered arrangement, uniform printing is possible over the recording width without dividing the substrate. However, the staggered arrangement gives rise to additional problems. Since the head unit has at least two recording lines, the amount of memory for the data to be printed between lines of the nozzles increases with increase of the distance Ln between the head unit lines. This increases the capacity of image memory of the main assembly to increase the cost of the apparatus and to decrease the processing speed. The drawbacks are particularly significant in the case of color ink jet apparatus or high density ink jet apparatus. With the increase of the distance Ln, the size of the recording head increases with the result of increase of the size of the recording apparatus. Accordingly, the distance Ln is desirably small.

With the structure disclosed in U.S. Pat. No. 5,160,945 is preferable in this respect because the head units lines are in contact. However, the electric connection with the external lines are carried out only a top surface of the substrate. This is not a significant problem when the density of the electrothermal transducer arrangement is low. However, when the electrothermal transducers are arranged at a high density, the resistance of a common electrode increases, because the common electrode for supplying the electric power is extended to the opposite side through between the ink supply port and the end surface of the substrate, so that the length of the common electrode is increased. In this case, the voltage drops through the common electrode are different when only one heat generating resistor is actuated than when all of the heat generating resistors are actuated, with the result that the voltages across the heat generating resistors are not uniform. If an attempt is made to increase the width of the common electrode in order to reduce the resistance of the common electrode, the size of the substrate has to be increased with the result of cost increase.

The similar problem occurs when the electrode pads for external connection are arranged at an end surface perpendicular to the line of the heat generating resistors. The position of connection to the electrode pads is limited to the opposite ends of the heat generating resistor line. For example, it is not possible to extend it from the middle portion of the line of the heat generating resistors, and therefore, the width of the common electrode is required to be increased to avoid the increase of the resistance of the common electrode. This leads to the increase of the size and cost of the substrate.

As another problem, when an attempt is made to reduce the distance Ln between adjacent head units each having the structure shown in FIG. 8, it is difficult, as will be understood from FIG. 9, to electrically connect the electrode pads 103 and the external lines at the portion where the head units are overlapped (a portion 301 in FIG. 9), and therefore, the distance between the head units is not decreased so much.

If TAB technique is used for electric connection between the electrode pads and the external lines in order to reduce the distance between recording materials, as disclosed in Japanese Laid-Open Patent Application No. 136616/1984, the positions of the external lines and the electrode pads are correctly aligned, and therefore, it is difficult to reduce the distance between adjacent head units.

SUMMARY OF THE INVENTION

Accordingly, it is a principal object of the present invention to provide an ink jet recording head substrate and an ink jet recording head using the same in which the distance between ejection outlets is reduced in each of the recording head units to decrease the manufacturing cost of the apparatus, and in which the electric connection to the heat generating resistors is easy.

According to an aspect of the present invention, there is provided an ink jet head substrate including a base plate; an elongated through opening, for ink supply port, extending in a longitudinal direction of the base plate; a plurality of heat generating resisters arranged on the base plate along both sides of the opening; a pair of electrodes electrically connected to the heat generating resisters; electrode pads for external electric connection, the pad being arranged adjacent opposite ends of the base plate substantially in parallel with a line along which the heat generating resisters are arranged; wherein a length Ls of the base plate measured in a direction along the line, a length Lh of a range in which the heat generating resisters are arranged, and a length Lp of a range in which the pads are disposed, satisfy $$Lp \leqq Ls-2\times(Ls-Lh).$$

According to this aspect, the overlapping of the electrode pads for the external connection can be avoided, so that the electric connection with the external lines are easy. Additionally, the TAB technique is usable. As a result, the distance between head units can be reduced, and the distance between ejection outlets can be reduced. This permits reduction of the image memory of the main assembly of the ink jet recording apparatus, and therefore, the cost of the ink jet recording apparatus can be reduced.

As regards the wiring, if the wiring is established between the opposite ends of the line of the heat generating resistor to the electrode pads for the external connection as the common electrode, the wiring is required to be extended therebetween because the electrode pads are arranged within a smaller range than that of the heat generating resistors. This results in increase of the electric resistance of the common electrode. If the width of the wiring is increased in an attempt to avoid the increase of the electric resistance, the size of the chip increases, and therefore, the chip cost increases.

According to another aspect of the present invention, the common electrode for supplying the electric energy to the heat generating resistor is extended in a direction in which the heat generating resistors are arranged. In addition, the wiring for connection with the pads is shortest so that the above-described problem can be avoided.

The number of layers of the electrodes increases for the purpose of the wiring for the electrodes, but the advantageous effect of the chip size reduction is more significant with the total result of cost decrease. In the case of the substrate in which the driving elements are built in the substrate, the number of electrode layers is not less than two for the driving elements, and therefore, there is no need of increasing the number of layers only for the electrodes.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Embodiment 1

Figure 1:
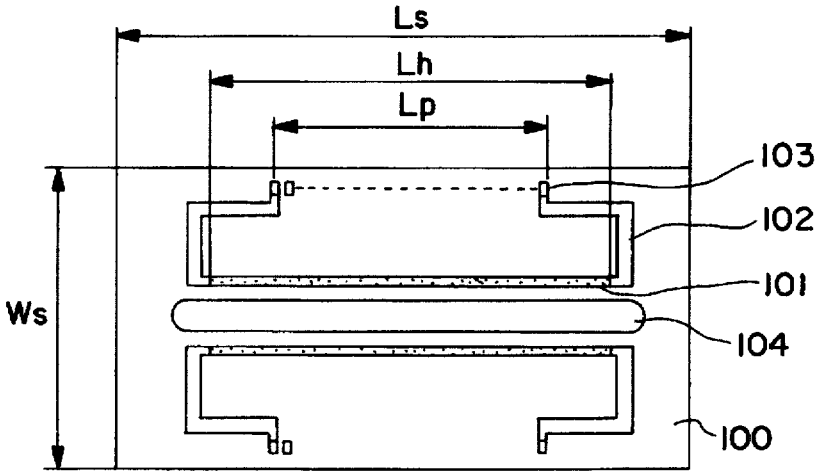
FIG. 1 is a top plan view of a substrate according to a first embodiment of the present invention.

FIG. 1 is a top plan view of an ink jet head substrate according to a first embodiment of the present invention.

Figure 2:
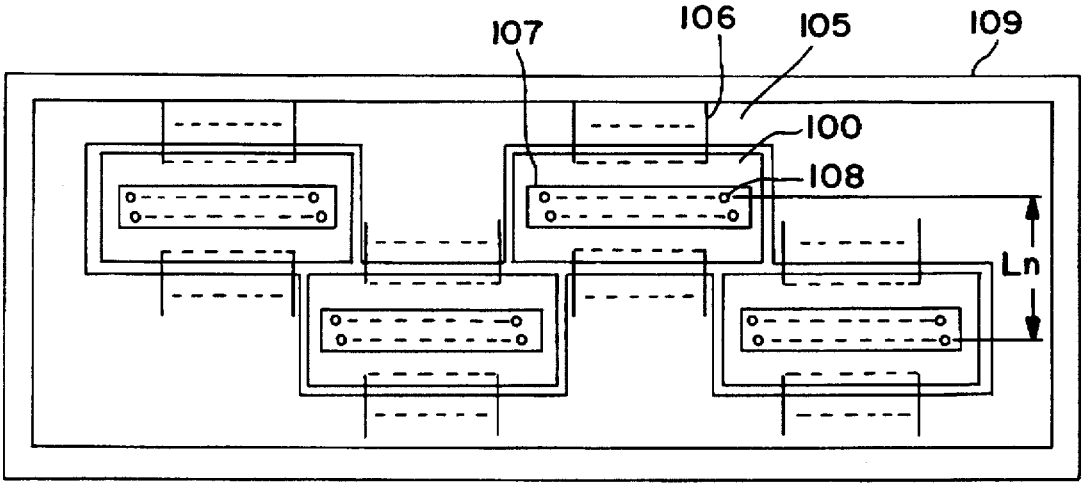
FIG. 2 is a top plan view of an ink jet head according to the first embodiment of the present invention.

FIG. 2 is a top plan view of an ink jet head according to this embodiment of the present invention in which the substrates are arranged in a staggered manner.

Figure 3:
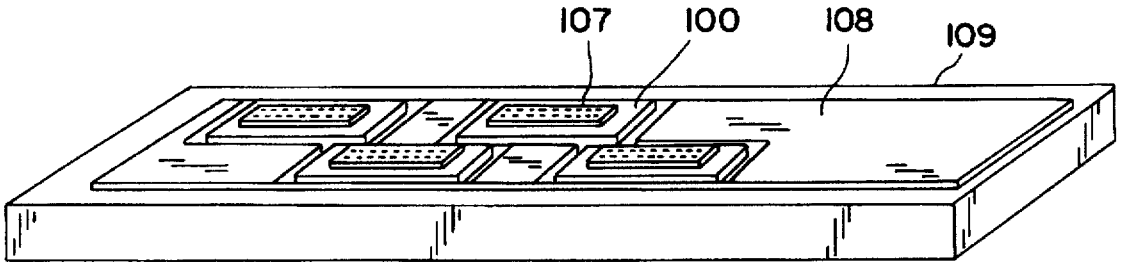
FIG. 3 is a perspective view of an ink jet head according to the first embodiment of the present invention.

FIG. 3 is a perspective view of an ink jet head according to this embodiment.

In FIGS. 1–3, reference numeral 100 designates a substrate (heater board) having heat generating resistors 101; 102, a common electrode for supplying electric energy to the heat generating resistors 102; 103, electrode pads for electric connection with external lines; 104, an ink supply port formed in the substrate 100; 105, an external wiring board; 106, external wiring; 107, an orifice plate in which ejection outlets 108 are formed; and 109, a support for supporting the substrate 100 and the external wiring board 105.

In those Figures, the dimensional legends are as follows:

Ls: Length of the substrate 100 measured in a direction along which the heat generating resistors 101 are arranged.

Lh: Length of the heat generating resistor range.

Lp: Length of a range in which the electrode pads 103 are provided.

Ws: Width of the substrate 100 measured in a direction perpendicular to the direction along which the heat generating resistors 101 are arranged.

Ln: A distance between nozzles of two head units.

Referring to FIG. 1, an ink supply port 104 for supplying the ink to the ink passages are formed substantially at the center in the longitudinal direction of the substrate 100, through the substrate 100. To lines of heat generating resistors 101 (ejection energy generating elements) for ejecting the ink are formed with the ink supply port 104 therebetween. To the opposite ends of the heat generating resistor line, common electrodes 102 are connected respectively. The common electrode 102 is extended away from the ink supply port 104 toward the end of the substrate, and is bent before the end of the substrate and is connected to the electrode pad 103 for connection with the external line. The electrode pads is extended along the longitudinal end of the substrate. In addition to the common electrode pads, there are provided additional pads connected with selection electrodes (not shown) electrically connected with respective heat generating resistors. Here, the length Lp of the area in which the electrode pads for external connection are disposed, satisfy the relationship $Lp \leqq Ls-2\times(Ls-Lh)$ wherein 2 is an integer. By forming such electrode pads, the electrode pads for external connection are disposed within an area where the substrates are not overlapped even when the substrates are arranged staggeredly.

By using the substrate 100 shown in FIG. 1, the distance Ln between nozzle lines can be minimized, by which the required amount of the image memory can be decreased, and therefore, the cost can be decreased. Additionally, the reduction of the amount of the memory results in increase of the processing speed. Since the electrode pads for the external connection and the respective electrodes are formed at opposite sides of the substrate, the length of the electrode pad arrangement region can be reduced without increasing the number of electrode pads. In addition, the necessity for long common electrode can be avoided to such an extent that the voltage drop is not a problem.

Table 1 gives numerical examples for a pitch of the heat generating resistors 101, the number of heat generating resistors 101, the length Ls, the width Ws, the length Lh, the number of electrode pads 103 for the external connection, a pitch of the electrode pad 103, and the length Lp.

TABLE 1

| | Resistor 101 | | | Pads 103 | | | Substrate 100 | |
|---|---|---|---|---|---|---|---|---|
| | Pitch (μ) | No. | Width Lh (mm) | Pitch (μ) | No. | Width Lp (mm) | Ls (mm) | Ws (mm) |
| Emb. 1 | 84.6 | 50 | 4.23 | 90 | 54 | 2.43 | 5.5 | 4.0 |
| Emb. 2 | 42.3 | 100 | 4.23 | 160 | 30 | 2.40 | 5.5 | 5.0 |
| Emb. 3 | 42.3 | 200 | 8.46 | 300 | 28 | 4.20 | 10.5 | 6.5 |
| Emb. 4 | 84.6 | 50 | 4.23 | 90 | 54 | 2.40 | 5.5 | 3.0 |
| Emb. 5 | 42.3 | 200 | 8.46 | 300 | 28 | 4.20 | 10.5 | 5.0 |

The required memory (bit number) and the distance Ln between nozzle lines when the ink jet head is manufactured using four substrates described above, as shown in FIG. 2, are as follows:

$$Ln = Ws + (\text{a width of nozzle lines}) = 4.0 + 0.4 = 4.4 \text{ mm}$$

Required amount of the memory=Ln/(pitch of the heat generating resistors)×(the number of nozzles)=$4.4\times10^{-3}/84.6\times10^{-6}\times50\times4$=10400 (bits)

Figure 8:
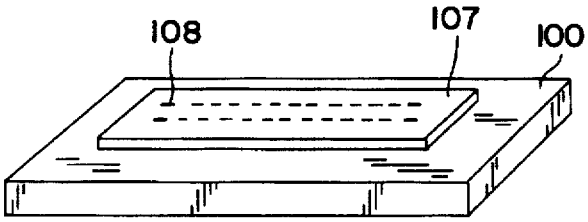
FIG. 8 PRIOR ART
FIG. 8 illustrates a conventional ejection element.
Figure 9:
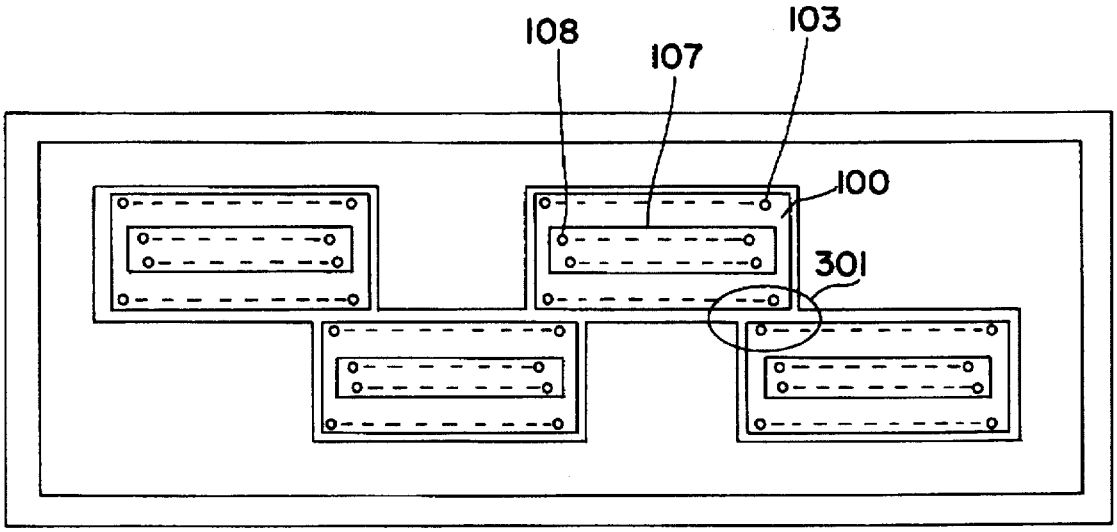
FIG. 9 PRIOR ART
FIG. 9 is a top plan view of a conventional ink jet head.

The same consideration is made to the conventional ink jet head shown in FIG. 9 using conventional substrates shown in FIG. 8. It is assumed that the dimensions of the substrate and the elements in the substrate are the same as the above except for the electrode pads. Since the external lines are to be provided between the substrates, at least 2 mm is required between substrates, and therefore, $$Ln = Ws + (\text{width of the nozzle lines}) + (\text{substrate internal}) = 4.0 + 0.4 + 2.0 = 6.4\text{mm}$$

The amount of the required memory is as follows:

Required memory=Ln/(the pitch of the heat generating resistors)×(the number of nozzles) =$6.4\times10^{-3}/84.6\times10^{-6}\times50\times4$=1513 (bits)

It will be understood that the amount of the required memory in this embodiment is approx. two thirds that required by the conventional structure.

The description will be made as to an example of a manufacturing method for the substrate of this embodiment. On a silicon wafer, a heat generating resistor layer ($HfB_2$) or the like and an electrode layer of Al or the like are formed in this order through thin film formation technique such as spattering or the like. The layers are patterned to provide the heat generating resistors 101 the common electrode 102 and selection (respective) electrode (not shown). Then, the silicon wafer is coated with protection layer of $SiO_2$ or the like, and thereafter, the through hole is formed in the portion where the electrode pads are formed. Additionally, gold is laminated to form the electrode pads at the through hole portion. This is then, patterned to provide the external electrode pads 103. Thereafter, the silicon wafer is cut into a predetermined size, thus providing the substrate (heater board) 100.

Figure 4:
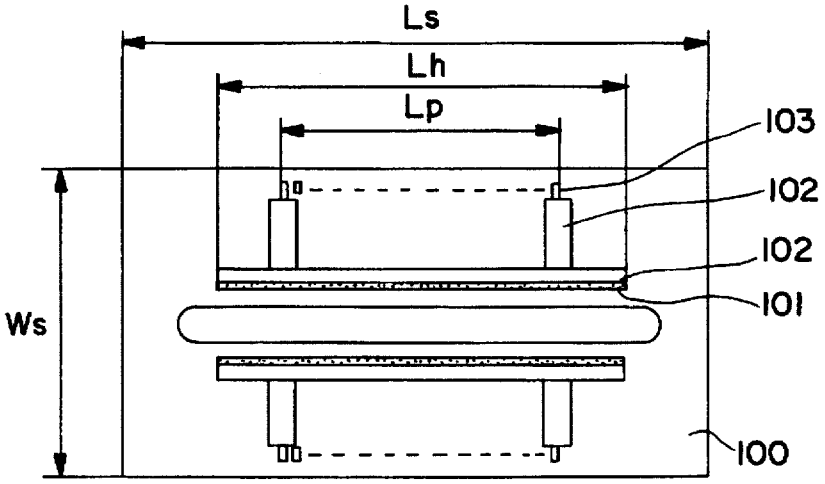
FIG. 4 is a top plan view of a substrate according to a second embodiment of the present invention.

An orifice plate 107 manufactured through electroforming, is bonded on the heater board so that the heat generating resistors are aligned with the ejection outlets. Thus, ejection element is manufactured. A plurality of such ejection elements are arranged in the staggered manner as shown in FIG. 4 and are bonded on the support 109 by a bonding material. Subsequently, an external electrode plate 105 comprising polyimide film having copper wiring 106 to which beam leads are connected (TAB) is bonded on the substrate. After completing all the wiring, the driving elements are shield by silicone resin material or the like to protect them from ink or humidity. In this manner, a recording head shown in FIG. 3 having the staggered ejection elements, are completed.

Embodiment 2

In Embodiment 1, the electrode is extended around adjacent the end portion. With the increase of the number of heat generating resistors, the increase of the voltage drop is not negligible. In Embodiment 2, the electrode is improved from this standpoint.

FIG. 4 is a top plan view of the substrate. As shown in this Figure, the pattern of the common electrode 102 is different from that in Embodiment 1.

More particularly, the common electrode 2 is in the form of a stripe extending codirectionally with the line of the heat generating resistors 101. Thus, the common electrode 102 and the electrode pad 103 for the external connection are connected with minimum distances. Therefore, the electrode layer has a two layer structure through an insulating layer as is different from Embodiment 1. However, as will be understood when FIGS. 4 and 1 are compared, the common electrode 102 is not extended around, and therefore, the dimension of the substrate 100 measured in the direction perpendicular to the line of the heat generating resistors 101 is made smaller. By the reduction of the size of the substrate, the distance Ln between nozzle lines can be reduced, and therefore, the required amount of the memory can be further reduced.

Table 1 also gives numerical examples for a pitch of the heat generating resistors 101, the number of heat generating resistors 101, the length Ls, the width Ws, the length Lh, the number of electrode pads 103 for the external connection, a pitch of the electrode pad 103, and the length Lp.

The required memory (bit number) and the distance Ln between nozzle are as follows:

$Ln=3.0+0.4=3.4\text{mm}$

Required amount of the memory=$Ln$/(pitch of the heat generating resistors)×(the number of nozzles)=$3.4\times10^{-3}/84.6\times10^{-6}\times50\times4=9038$ (bits)

It will be understood that the amount of the required memory in this embodiment is reduced.

As will be understood from the above, the capacity of the memory can be reduced as compared with Embodiment 1.

Embodiment 3

Figure 5:
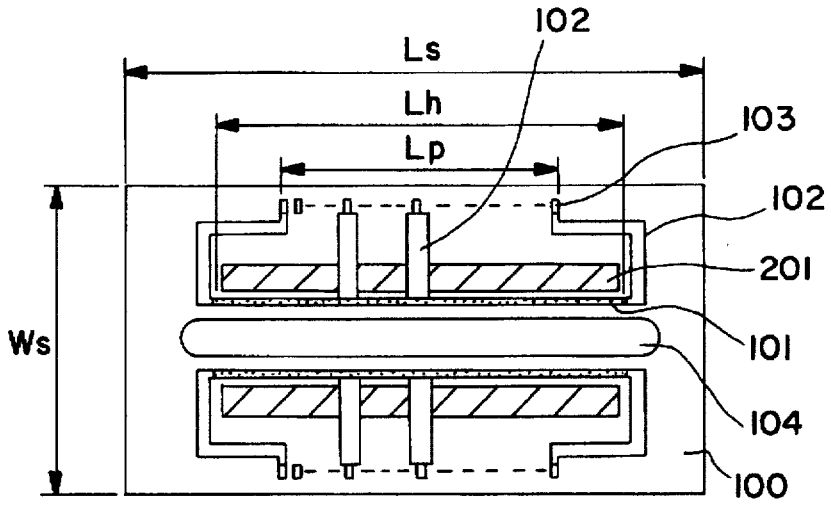
FIG. 5 is a top plan view of a substrate according to a third embodiment of the present invention.

FIG. 5 is a top plan view of a substrate (corresponding to FIG. 1) of Embodiment 3. In this embodiment, the density of the heat generating resistor 101 arrangement is so high that the pitch of the electrode pads 103 for the external connection of the respective electrodes is too small to carry out the afterward electric connection. Therefore, the number of electrode pads 103 is reduced. To accomplish this, driving elements 201 is built in the substrate 100 through the semiconductor manufacturing process. The signal lines for the driving elements 201 and the GND lines for the driving elements 201 are formed into a matrix, thus reducing the number of external connection electrode pads 201.

Such driving elements can be manufactured through known NMOS process, for example. Except for the built in driving elements, this embodiment is the same as in the first embodiment in the manufacturing method.

Table 1 gives numerical examples for a pitch of the heat generating resistors 101, the number of heat generating resistors 101, the length Ls, the width Ws, the length Lh, the number of electrode pads 103 for the external connection, a pitch of the electrode pad 103, and the length Lp.

It will be understood that the amount of the required memory in this embodiment is reduced.

The required capacity of the image memory can be reduced, and the manufacturing cost can be reduced.

Embodiment 4

Figure 6:
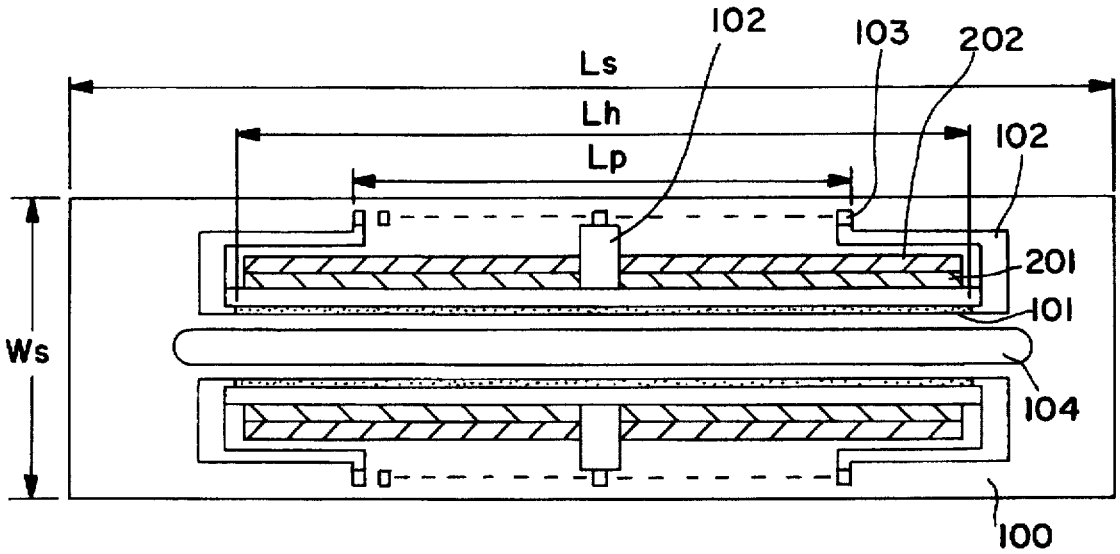
FIG. 6 is a top plan view of a substrate according to a fourth embodiment of the present invention.

FIG. 6 is a top plan view of a substrate according to Embodiment 4. In Embodiment 3, FIG. 6 is a top plan view of a substrate (corresponding to FIG. 1) of Embodiment 4. In this embodiment, the density of the heat generating resistor 101 arrangement is so high that the pitch of the electrode pads 103 for the external connection of the respective electrodes is too small to carry out the afterward electric connection. Therefore, the number of electrode pads 103 is reduced. To accomplish this in Embodiment 3, driving elements 201 is built in the substrate 100 through the semiconductor manufacturing process. The signal lines for the driving elements 201 and the GND lines for the driving elements 201 are formed into a matrix, thus reducing the number of external connection electrode pads 201.

However, the number of electrode pads 103 is still large. In this embodiment, the driving elements 201 and the logic circuit for driving them, for example, shift register are built in, thus further reducing the number of electrode pads 103. Such shift registers can be manufactured together with the driving elements and latching circuit through known Bi-CMOS process.

Except for the built in logic circuits, the manufacturing process is the same as in Embodiment 3.

Table 1 gives numerical examples for a pitch of the heat generating resistors 101, the number of heat generating resistors 101, the length Ls, the width Ws, the length L1, the number of electrode pads 103 for the external connection, a pitch of the electrode pad 103, and the length Lp.

It will be understood that the amount of the required memory in this embodiment is reduced.

As will be understood, the required capacity of the image memory can be reduced similarly to Embodiment 3, and therefore, the cost of the apparatus can be reduced.

Embodiment 5

Figure 7:
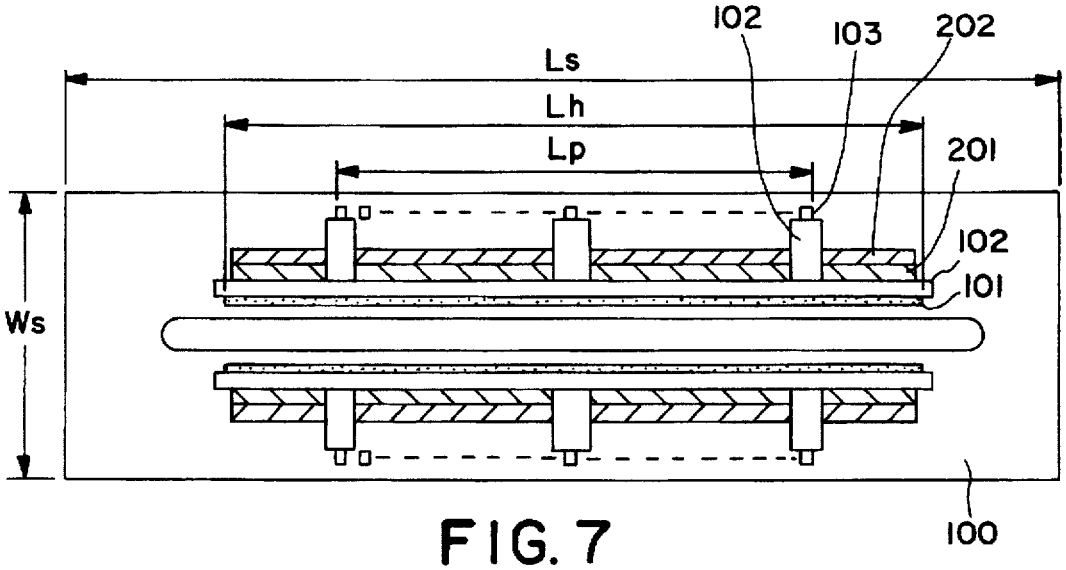
FIG. 7 is a top plan view of a substrate according to a fifth embodiment of the present invention.

FIG. 7 is a top plan view of the substrate according to Embodiment 5 of the present invention. The manufacturing method of the substrate of this embodiment is similar to that in Embodiment 4. However, as shown in FIG. 7, the pattern of the common electrode 102 is different.

More particularly, the common electrode 102 is in the form of a stripe extending in a direction in which the heat generating resistors 101 are arranged. By this, the common electrode 102 and the electrode pad 103 are connected through minimum distance. Therefore, the number of electrode layers is increased, but by the common use of the electrode layers for the driving elements 201 and the logic circuit element 202, the number of electrode layer is not increased. As will be understood from comparison between FIGS. 7 and 5, the electrode 102 is not extended around, and therefore, the dimension of the substrate 100 measured in a direction perpendicular to the direction of the line of the heat generating resistor 101 line, is shorter than in Embodiment 3.

By avoiding the increase of the number of electrode layers, the liability of improper insulation between electrode layers can be avoided, thus increasing the reliability.

Table 1 gives numerical examples for a pitch of the heat generating resistors 101, the number of heat generating resistors 101, the length Ls, the width Ws, the length Lh, the number of electrode pads 103 for the external connection, a pitch of the electrode pad 103, and the length Lp.

It will be understood that the amount of the required memory in this embodiment is reduced.

Figure 10:
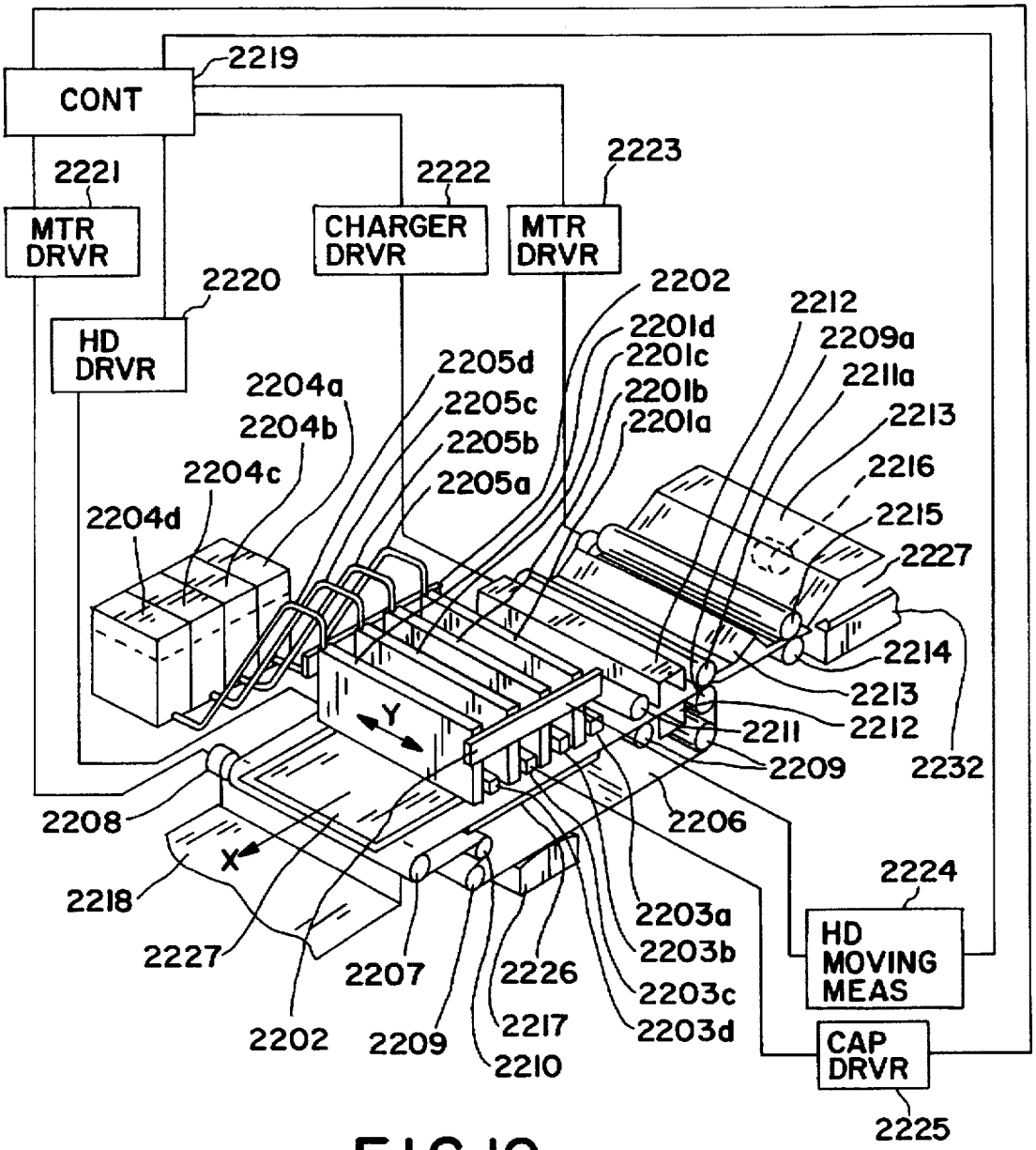
FIG. 10 is a schematic view of an ink jet recording apparatus having a full-line type ink jet head using the substrate according to the present invention.

Referring to FIG. 10, there is shown an example of an ink jet apparatus using the ink jet head of full-line type using the substrate of the present invention.

As shown in FIG. 10, the ink jet apparatus is provided with a line type heads 2201*a*–2201*d*, and the line type head 2201*a*–2201*d* are securedly supported by a holder 2202 with predetermined intervals in the direction X with parallelism therebetween. The bottom surface of each of the heads 2201*a*–2201*d* is provided with 3456 ejection outlet facing downwardly at the intervals of 16 ejection outlets per mm in a line along Y direction. By this, 218 mm width can be recorded.

Each of the head 2201*a*–2201*d* ejects recording liquid using thermal energy, and is controlled by head driver 2220. A head unit is constituted, including heads 2201*a*–2201*d* and the holder 202. The head unit is movable in the vertical direction by head moving means 224.

Below the heads 2201*a*–2201*d*, head caps 2203*a*–2203*d* are disposed adjacent to one another corresponding to the heads 2201*a*–2201*d*. Each of the head caps 2203*a*–2203*d* contains ink absorbing material such as sponge therein.

The caps 2203*a*–2203*d* are supported by an unshown holder. A cap unit is constituted, including the holder and caps 2203*a*–2203*d*. The cap unit is movable in X direction by the cap moving means 2225.

To the heads 2201*a*–2201*d*, cyan, magenta, yellow and black inks are supplied from ink containers 2204*a*–2204*d* through ink supply tubes 2205*a*–2205*d*, respectively, to permit color printing.

The ink supply is effected by capillary action of the ejection outlet. Therefore, the liquid levels in the ink containers 2204*a*–2204*d* are lower by a predetermined distances from the ejection outlet positions.

The apparatus is provided with an electrically chargeable seamless belt 2202 for feeding the recording sheet 227 (recording material).

The belt 2206 is extended around a driving roller 2207, idler rollers 2209 and 2209*a* and a tension roller 2210 and is driven by a belt driving motor 2208 operatively connected with the driving roller 2207 and controlled by a motor driver 2221.

The belt 2206 travels in X direction light below the ejection outlets of the heads 2201*a*–2201*d*. The downward deflection thereof is confined by a secured support 2226.

A cleaning unit 2217 functions to remove paper dust or the like deposited on the surface of the belt 2206.

A charger 2212 functions to electrically charge the belt 2206. The charger 2212 is actuated or deactuated by a charger driver 2222. By the electrostatic attraction force provided by the electric charging, the recording material is attracted on the belt 2206.

Before and after the charger 2212, pinch rollers 2211 and 2211*a* are disposed to cooperate with the idler rollers 2209 and 2209*a* to urge the recording sheet 2227 to the belt 2206.

The recording materials 2227 are contained in a cassette 2232, and is fed out one-by-one by rotation of a pick-up roller 2216 driven by the motor driver 2223, and is fed to an apex guide 2213 in a direction X by the feeding roller 2214 and the pinch roller 2215 controlled by the same driver 2223. The guide 2213 is provided with an apex space to permit flexing of the recording sheet.

Reference numeral 2218 designates a sheet discharge tray for receiving the discharged sheet.

The above-described head driver 2220, the head moving means 2224, the cap moving means 2225, the motor drivers 2221 and 2223 and the charger driver 2222, are all controlled by a control circuit 2219.

In the foregoing embodiments, the ink has been described as liquid ink. However, a solid ink which is solid at room temperature or lower and is requified above the room temperature. Generally, in the ink jet type, the ink is heated to a temperature 30° C.–70° C. to stabilize the viscosity of the ink. Therefore, the ink may be the one which is requified upon the application of the recording signal. Additionally, the ink may be the one which is solid but is requified by heating.

The present invention is applicable to a textile printing apparatus which highly demands a long ink jet head or to a textile printing system comprising pre-processing apparatus and post-processing apparatus. By using the present invention, the long ink jet head capable of printing without nonuniformity, can be provided. Therefore, a textile printing apparatus or system capable of printing very fine images with high quality, can be provided.

When the ink jet head according to the present invention is used, disturbance in the image can be avoided in a facsimile machine, copying machine or printer or the like.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head substrate comprising:

a base plate;

an elongated through opening, for ink supply port, extending in a longitudinal direction of said base plate;

a plurality of heat generating resistors arranged on said base plate along both sides of said opening;

a pair of electrodes electrically connected to said heat generating resistors;

electrode pads for external electric connection said pad being arranged adjacent opposite ends of said base plate substantially in parallel with a line along which said heat generating resistors are arranged;

wherein a length Ls of said base plate measured in a direction along the line, a length Lh of a range in which said heat generating resistors are arranged, and a length Lp of a range in which said pads are disposed, satisfy the relationship, $$Lp \leqq Ls-2\times(Ls-Lh),$$

wherein 2 is an integer.

2. A substrate according to claim 1, wherein said pair of electrodes comprises discrete electrodes and a common electrode which is effective to supply electric energy to said heat generating resistors, and said common electrode is extended toward the opposite ends of said base plate and is curved adjacent the ends and is connected to said pads.

3. A substrate according to claim 2, further comprising built-in driving elements for driving said heat generating resistors.

4. A substrate according to claim 3, further comprising built-in controlling elements for the driving elements.

5. A substrate according to claim 1, wherein said pair of electrodes comprises discrete electrodes and a common electrode which is effective to supply electric energy to said heat generating resistors, and said common electrode is in a form of a stripe extending along the line, and said common electrode is connected to the pads with minimum distance.

6. A substrate according to claim 5, further comprising built-in driving elements for driving said heat generating resistors.

7. A substrate according to claim 6, further comprising built-in controlling elements for the driving elements.

8. An ink jet head comprising:

a plurality of substrates arranged staggeredly, each of said substrates including:

a base plate;

an elongated through opening, for ink supply port, extending in a longitudinal direction of said base plate:

a plurality of heat generating resistors arranged on said base plate along both sides of said opening;

a pair of electrodes electrically connected to said heat generating resistors;

electrode pads for external electric connection, said pad being arranged adjacent opposite ends of said base plate substantially in parallel with a line along which said heat generating are arranged;

wherein a length Ls of said base plate measured in a direction along the line, a length Lh of a range in which said heat generating are arranged, and a length Lp of a range in which said pads are disposed, satisfy the relationship, $$Lp \leqq Ls-2\times(Ls-Lh),$$

wherein 2 is an integer;

ejection outlets faced to each of said heat generating resistors, respectively; and ink passages in fluid communication with said ejection outlets and with the supply port.

9. An ink jet head according to claim 8, wherein said pair of electrodes comprises discrete electrodes and a common electrode which is effective to supply electric energy to said heat generating resistors, and said common electrode is extended toward the opposite ends of said base plate and is curved adjacent the ends and is connected to said pads.

10. An ink jet head according to claim 9, further comprising built-in driving elements for driving said heat generating resistors.

11. An ink jet head according to claim 10, further comprising built-in controlling elements for the driving elements.

12. An ink jet head according to claim 8, wherein said pair of electrodes comprises discrete electrodes and a common electrode which is effective to supply electric energy to said heat generating resistors, and said common electrode is in a form of a stripe extending along the line, and said common electrode is connected to the pads with minimum distance.

13. An ink jet head according to claim 12, further comprising built-in driving elements for driving said heat generating resistors.

14. An ink jet head according to claim 13, further comprising built-in controlling elements for the driving elements.

15. An ink jet head according to claim 8, wherein said ink jet head has a recording width larger than a width of a recording material.

16. An ink jet apparatus comprising:

an ink jet head including;

a plurality of substrates arranged staggeredly, each of said substrates including;

a base plate;

an elongated through opening, for ink supply port, extending in a longitudinal direction of said base plate:

a plurality of heat generating resistors arranged on said base plate along both sides of said opening;

a pair of electrodes electrically connected to said heat generating resistors;

electrode pads for external electric connection, said pad being arranged adjacent opposite ends of said base plate substantially in parallel with a line along which said heat generating resistors are arranged;

wherein a length Ls of said base plate measured in a direction along the line, a length Lh of a range in which said heat generating resistors are arranged, and a length Lp of a range in which said pads are disposed, satisfy the relationship, $$Lp \leqq Ls-2\times(Ls-Lh),$$

wherein 2 is an integer;

ejection outlets faced to each of said heat generating resistors, respectively; and ink passages in fluid communication with said ejection outlets and with the supply port;

an ink container for containing ink being supplied to said ink jet head.

* * * * *

UNITED STATES PATENT AND TRADEMARK OFFICE

CERTIFICATE OF CORRECTION

PATENT NO. : 5,696,544

DATED : December 9, 1997

INVENTOR(S) : HIROKAZU KOMURO

It is certified that error appears in the above-identified patent and that said Letters Patent is hereby corrected as shown below:

[57] ABSTRACT

Line 4, "resisters" should read --resistors--.
Line 6, "resisters" should read --resistors--.
Line 9, "resisters" should read --resistors--.
Line 12, "resisters" should read -- resistors --

COLUMN 1

Line 10, "substrates" should read --substrate--.
Line 19, "method" should read --methods--.
Line 21, "the" should read --in the--.
Line 25, "eject" should read --ejects--.
Line 35, "for" should read --for the--.

COLUMN 2

Line 11, "non-printable" should read --the non-printable--.
Line 35, "With the" should read --The--.
Line 38, "only" should read --only on--.

COLUMN 5

Line 3, "are" should read --is--.
Line 7, "ther-" should read --there---.
Line 8, "ebetween" should read --between--.
Line 14, "is" should read --are--.
Line 34, "for" should read --for a--.

UNITED STATES PATENT AND TRADEMARK OFFICE

CERTIFICATE OF CORRECTION

PATENT NO. : 5,696,544

DATED : December 9, 1997

INVENTOR(S) : HIROKAZU KOMURO

It is certified that error appears in the above-identified patent and that said Letters Patent is hereby corrected as shown below:

COLUMN 6

Line 23, "technique" should read --techniques--.
Line 31, "then," should read --then--.
Line 38, "ejection" should read --the ejection--.
Line 45," shield" should read --shielded--.

COLUMN 7

Line 35, "is" should read --are--.
Line 66, "is" should read --are--.

COLUMN 8

Line 6, "register" should read --registers,--.
Line 15, "L1," should read --Lh,--.
Line 38, "layer" should read --layers--.
Line 60, "a" should be deleted, and "head" should read --heads--.
Line 61, "securedly" should read --securely--.
Line 64, "outlet" should read --outlets--.

COLUMN 9

Line 20, "distances" should read --distance--.
Line 30, "light" should read --right--.
Line 44, "is" should read --are--.
Line 45, "is" should read --are--.

UNITED STATES PATENT AND TRADEMARK OFFICE

CERTIFICATE OF CORRECTION

PATENT NO. : 5,696,544

DATED : December 9, 1997

INVENTOR(S) : HIROKAZU KOMURO

It is certified that error appears in the above-identified patent and that said Letters Patent is hereby corrected as shown below:

COLUMN 10

Line 62, "as" should read --as a--.

COLUMN 11

Line 62, "are" should read --resistors are--.
Line 65, "are" should read --resistors are--.

Signed and Sealed this

Thirteenth Day of October 1998

*Attest:*

*Attesting Officer*

BRUCE LEHMAN

*Commissioner of Patents and Trademarks*